US005897122A

United States Patent [19]

Borner

[11] Patent Number: 5,897,122

[45] **Date of Patent: *Apr. 27, 1999**

[54] MECHANIC'S RECLINER CHAIR

[75] Inventor: Willy Borner, Cupertino, Calif.

[73] Assignee: Snap-on Technologies, Inc., Lincolnshire, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,318

[22] Filed: Feb. 9, 1996

[51] Int. Cl.[6] ..... B25H 5/00

[52] U.S. Cl. ..... 280/32.6; 280/79.11; 297/217.7

[58] Field of Search ..... 297/452.14, 217.7, 297/327, 328; 280/32.5, 32.6, 47.38, 47.4, 79.11

[56] References Cited

U.S. PATENT DOCUMENTS

| | | | |
|---|---|---|---|
| 2,487,706 | 11/1949 | Happ | 280/32.6 |
| 2,796,155 | 6/1957 | Cabler | 280/32.5 X |
| 2,986,200 | 5/1961 | Nobile | 297/327 |
| 3,034,830 | 5/1962 | Avedon | 297/452.14 X |
| 3,252,249 | 5/1966 | Propst | 280/32.5 X |
| 4,231,612 | 11/1980 | Meeker | 297/327 X |
| 4,957,302 | 9/1990 | Maxwell | 280/32.6 |
| 5,249,838 | 10/1993 | Kulpa et al. | 297/328 |
| 5,330,211 | 7/1994 | Nicholson | 280/32.6 |
| 5,516,134 | 5/1996 | Crawford | 297/452.14 X |

FOREIGN PATENT DOCUMENTS

| | | | |
|---|---|---|---|
| 459783 | 9/1968 | Switzerland | 280/32.6 |
| 09709 | 12/1988 | WIPO | 280/32.6 |

OTHER PUBLICATIONS

*Harbor Freight Tools Summer 1996 Catalog* (Tel: 1800–423–2567); p. 45.

*Sporty's Summer 1996 Catalog* (Tel: 1800–543–8633), pp. 63 and 70.

*Snap–on Tool Co. 1996 Catalog*, p. 228.

*Primary Examiner*—J J Swann
*Assistant Examiner*—Michael Mar
*Attorney, Agent, or Firm*—Emrich & Dithmar

[57] ABSTRACT

Mechanic's recliner chair including a rectangular wheeled platform having a molded plastic chair form affixed thereto with the back reclined to an angle of approximately 44° from horizontal, and a seat inclined to approximately 20° from horizontal. The platform may include drawer means for containing tools, manuals, etc., and other facilities for holding ratchets, wrenches, etc.

9 Claims, 2 Drawing Sheets

MECHANIC'S RECLINER CHAIR

BACKGROUND OF THE INVENTION

1. Field of the Invention

The present invention relates generally to mechanics' support apparatus, generally referred to in the art as creeper devices, and more particularly to an improved reclining chair apparatus specifically adapted for use by mechanics carrying out alignment operations using modern automated wheel alignment equipment.

2. Discussion of the Prior Art

In the automotive repair industry, a wide variety of mechanics' creeper devices and rolling seats are available. However, most such devices are intended for use beneath a partially jacked vehicle (i.e., the familiar creeper platform) or alongside a vehicle (for example, the rolling utility seat). Recently, new creeper designs have included raisable portions to provide support to head and neck during long periods of work beneath an automobile.

With the advent of new wheel alignment apparatus such as the type described in applicant's co-pending U.S. Pat. application Ser. No. 08/544,378 filed Oct. 10, 1995, entitled "METHOD AND APPARATUS FOR DETERMINING THE ALIGNMENT OF MOTOR VEHICLE WHEELS", it is convenient to place the automobile being aligned on a fixed or raisable rack that positions the vehicle approximately 24" to 36" above the shop floor to enable convenient access to the underside of the car for wheel alignment adjustment purposes while at the same time allowing wheel orientation to be detected. Although the above-mentioned creeper devices having adjustable back and head support portions can be used with an auto at this elevation, they are clumsy to use because of their size and length, and have other disadvantages relating to poor access and transportability of tools, stowage considerations, and ease of mobility. Furthermore, when the back support portion is inclined, the user tends to slide forward on the seat support portion.

There is therefore a need for a lightweight reclining chair having the attributes of stability in use, adequate back support, good access to tools, and smallness in size.

SUMMARY OF THE INVENTION

It is therefore a principal objective of the present invention to provide a mechanic's reclining chair addressing the attributes mentioned above.

Briefly, a preferred embodiment of the present invention includes a rectangular wheeled platform having a molded plastic chair form affixed thereto with the back reclined to an angle of approximately 44° from horizontal, and a seat inclined to approximately 20° from horizontal. The platform may include drawer means for containing tools, manuals, etc., and other facilities for holding ratchets, wrenches, etc.

An advantage of the present invention is that it provides a lightweight, properly angled recliner particularly suited for use by a mechanic as he attempts to manipulate automotive alignment adjustment fittings and connections.

Another advantage of the present invention is that because the molded chair form is of the type generally referred to as a "bucket seat" conforming to the body shape of the user, it provides lateral body support to assist in lateral movement of the device, keeps the body centered on the seating unit, and tends to resist body slippage on the seating unit when the user applies force to loosen or tighten bolts or fasteners.

These and other objects and advantages of the present invention will no doubt become apparent to those skilled in the art after having read the following detailed description of the preferred embodiment which is illustrated in the several figures of the drawing.

IN THE DRAWING

DETAILED DESCRIPTION OF THE PREFERRED EMBODIMENT

Figure 1:
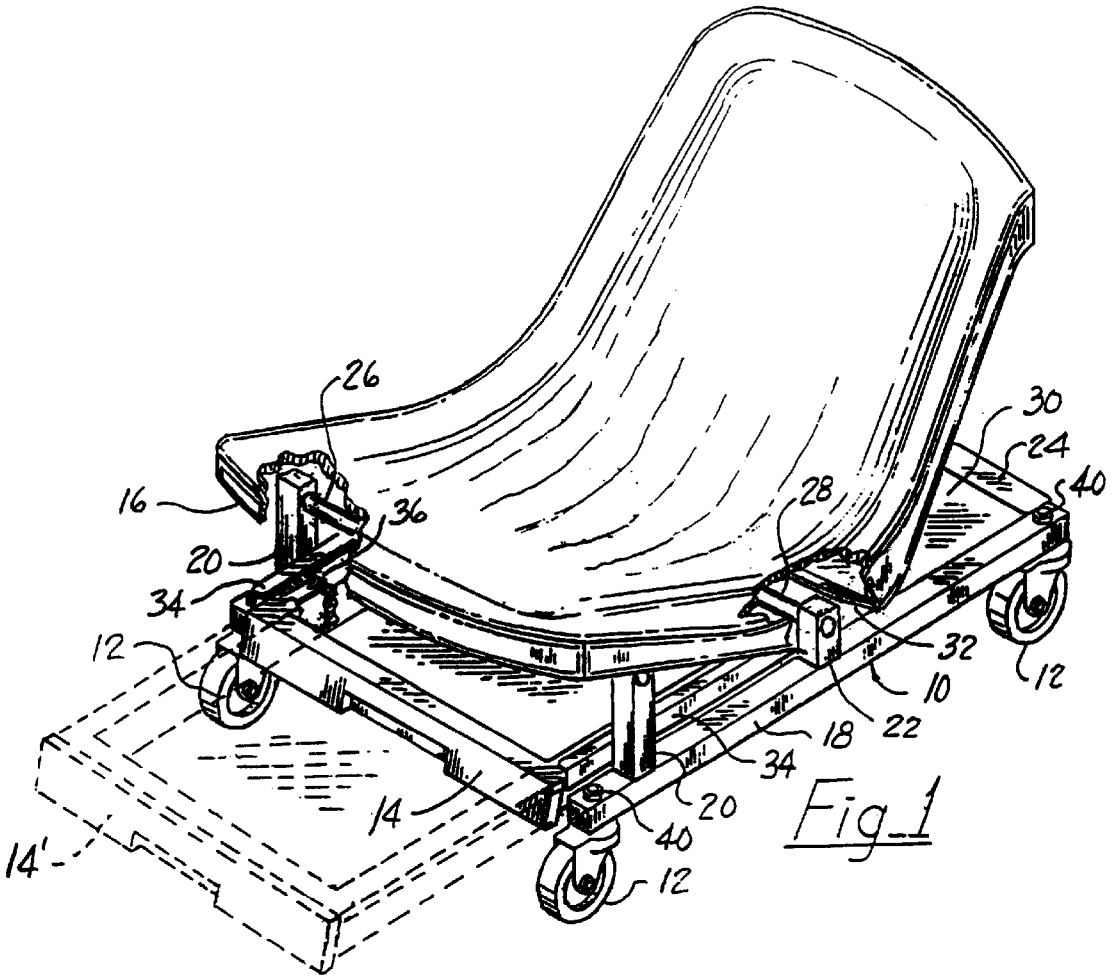
FIG. 1 is a perspective view illustrating a mechanic's recliner chair in accordance with a preferred embodiment of the present invention.

Referring now to FIG. 1 of the drawing, there is shown a mechanic's recliner support apparatus in accordance with the present invention including a rectangular platform 10 supported by four swiveled wheels 12, a tool stowage drawer 14, and a seating and back support unit disposed in a tilted or reclined configuration, as will be more specifically described below.

The platform 10 is comprised of a pair of side rails 18 having affixed to the upper surfaces thereof a pair of risers 20 extending upwardly therefrom proximate the front extremities of the rails 18, and a pair of shorter risers 22 disposed at midlength. The rails are secured together by means of a rear cross-member 24 and a pair of tubular chair support rods 26 and 28 spanning the distance between risers 20 and 22, respectively. A flat sheet 30 forms a rear cover plate for platform 10 and terminates at its forward end with an upturned edge 32.

Extending along the facing sides of each rail 18 and positioned slightly thereabove are slides 34 which are affixed to risers 20 and 22. Slides 34 receive outwardly extending edges 36 of drawer 14 and permit the drawer to be extended forwardly to the position indicated by the dashed lines 14'.

The wheels 12 are in the form of casters which are affixed to each end of the rails 18 by means of vertically extending bolts secured by nuts 40, and provide complete freedom of directional movement of the unit.

Seat 16 is a preformed, molded plastic unit that is affixed to the tubes 26 and 28 by suitable fasteners (not shown) which secure its bottom side thereto.

Figure 2:
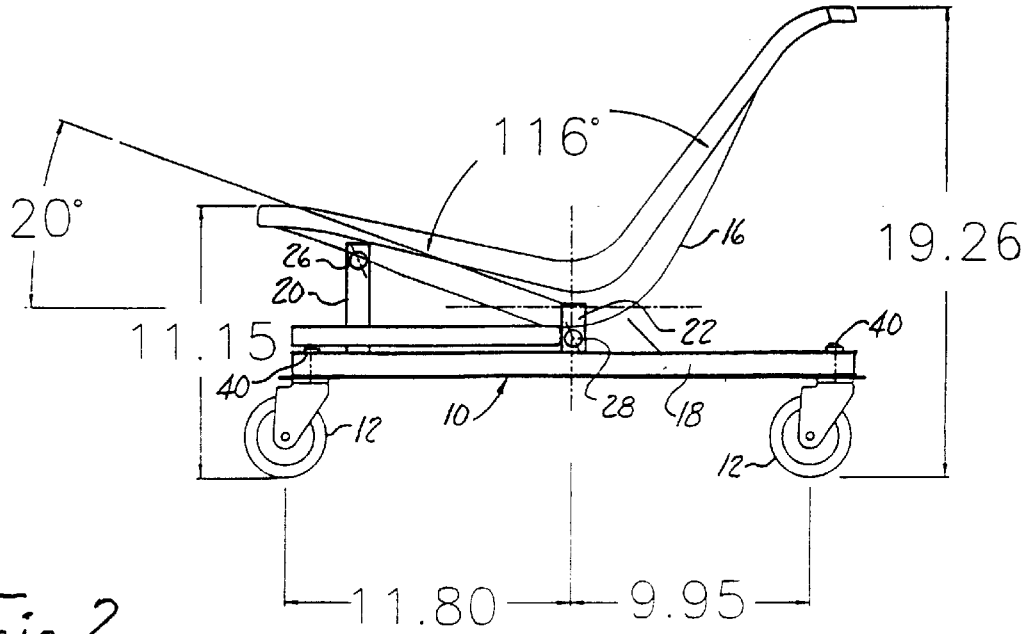
FIG. 2 is a schematic side elevation thereof illustrating relative dimensions and angular inclinations of the preferred embodiment.

Referring now to FIG. 2 of the drawing, the relative proportions of the preferred embodiment are illustrated. Note that the rails 18 are approximately 24" long and the risers 22 are positioned at the midpoint of each rail. The swivel axes 40 of the casters 12 are positioned equidistant from the midpoint support 22 and thus the midpoint of platform 10. The positions of the tubular seat supports 26 and 28 above rails 18 are chosen to provide a rearwardly tilted angle of inclination of seat unit 16 of approximately 20°, so that with a seat-to-back angle of approximately 116° the rearward inclination of the back support portion of seat 16 is approximately 44°. Note also that the height of the back support portion of seat 16 is approximately 19¼ above the supporting surface, so as to provide good back support to the user but still not interfere with upper body motion. Although not specifically indicated in FIG. 2, the width of the unit is approximately 18".

Because of its elongated, rectangular configuration supported at four points, and because the chair unit is carried by the forward portion of the the platform 10, a stable support is provided for the reclining chair unit 16 that will resist rearward tilting even in situations where the mechanic is making maximum rearward reach. Furthermore, the inclination of the forward portion of seat 16 tends to prevent forward sliding of the user on the seat as he leans rearwardly to access an adjustment fixture on the vehicle.

Figure 3:
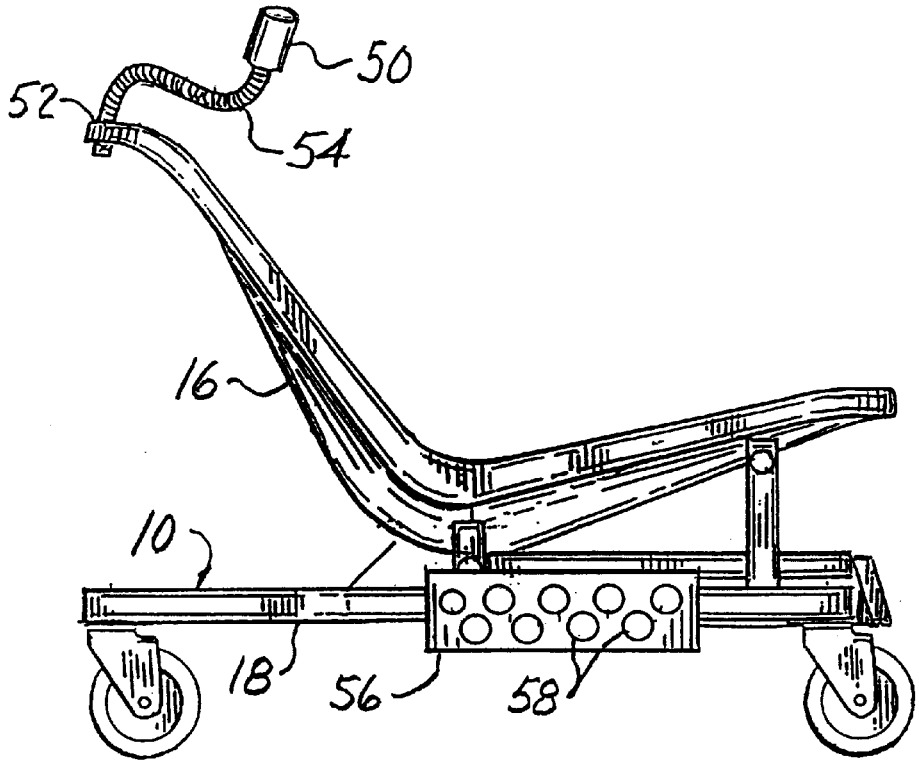
FIGS. 3 and 4 are side elevations of the preferred embodiment illustrating various accessories and enhancements that can be included as a part of the apparatus.
Figure 4:
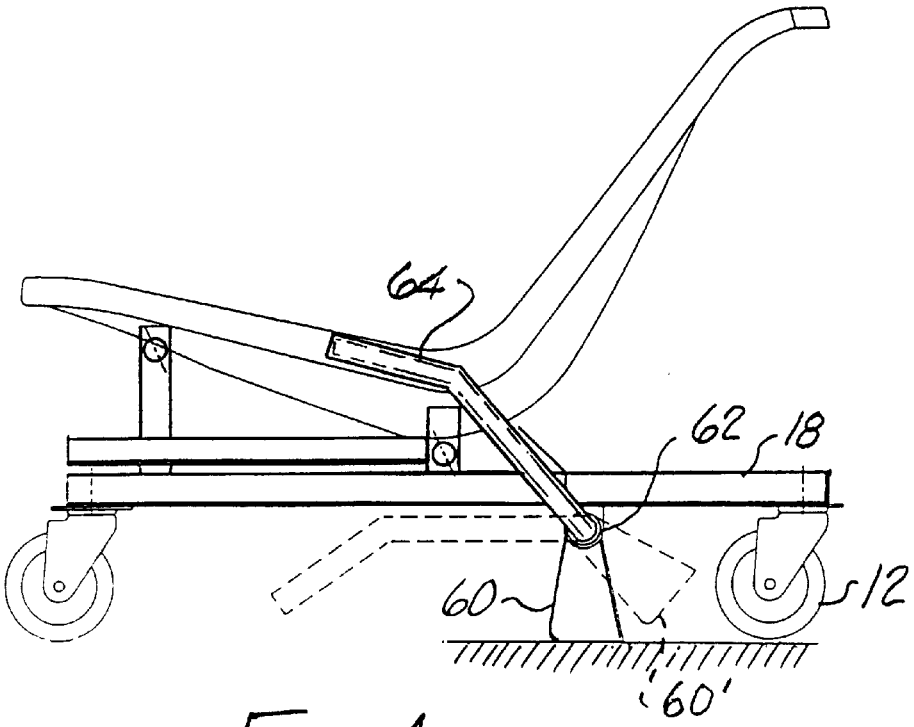

Turning now to FIGS. 3 and 4, additional accessories and features of the present invention are illustrated, including, as depicted in FIG. 3, an adjustable lighting mechanism 50 which is attached to the upper extremity of seat 16 at 52 and supported therefrom by a goosenecked, adjustable linkage 54 to facilitate positioning and direction of the light. Ideally, the attachment point 52 would be to one side or the other of the seat back so as not to interfere with rearward head motion or reach of the user but still permit positioning and direction of the light 50 as close as possible to the user's line of sight.

As an added convenience, a magnetic socket holder 56 may be attached to the side rails 18 on one or both sides of the platform 10. The unit 56 may include a plurality of open receptacles 58 for receiving ratchets, sockets or the like, and holding them in position by virtue of a magnetized plate embedded in the base of the unit.

In FIG. 4 of the drawing, an optional braking unit is illustrated including a brake foot 60 which is pivotally secured beneath rails 18 at 62 and rotatable between a braking position, as illustrated by the solid lines, wherein the rear wheels 12 are slightly lifted from the supporting surface, and a retracted position, as indicated by the dashed lines 60'. A side handle unit 64 is used to position the brake element 60. Use of the braking feature is of particular advantage where the user must apply substantial torqueing force to a wrench in order to loosen a tight bolt or nut.

Although the present invention has been described above in terms of a specific preferred embodiment, it will be appreciated that certain variations and alterations may be made thereto, and certain additional features added without departing from the merits of the invention. It is therefore intended that the following claims be interpreted to include all such alterations and modifications as fall within the true spirit and scope of the invention.

What is claimed is:

1. A mechanic's recliner chair comprising:

an elongated platform having a longitudinal axis, a forward end and a rearward end;

a first support structure including a first pair of transversely-spaced risers connected to the platform and a first support member connecting the risers of the first pair, the first support structure being disposed substantially midway between the forward end and the rearward end of the platform;

a second support structure including a second pair of transversely-spaced risers connected to the platform and a second support member connecting the risers of the second pair, the second support structure being disposed proximate said forward end of the platform;

a pluralty of casters respectively supporting corners of the platform; and an integrally formed one-piece seating unit fixedly attached to and fully supported only in said first and second support structures, said seating including an inclined seat portion and an inclined back support portion fixedly disposed with respect to the seat portion and extending rearwardly and upwardly from the seat portion, a junction between said seat portion and said back support portion being at a substantially lower elevation than a forwardmost extremity of said seat portion and a rearwardmost extremity of said back support portion, the seating unit being fixedly attached to said first support structure proximate said junction, the rearwardmost extremity of said back support portion being disposed at substantially the same position along the longitudinal axis as the rearward end of the platform, wherein the mechanic's chair is adapted to be propelled by the feet of a user when the user is seated in the seating unit.

2. A mechanic's recliner chair as recited in claim 1 wherein said seat portion is inclined such that a forward extremity thereof is positioned substantially higher above said platform than is a rearward portion thereof.

3. A mechanic's recliner chair as recited in claim 1 and further comprising a receptacle for containing mechanic's tools, said receptacle being affixed to said platform.

4. A mechanic's recliner chair as recited in claim 3 wherein said receptacle is a drawer slidably coupled to said platform.

5. A mechanic's recliner chair as recited in claim 1 wherein said receptacle is a magnetic tool holder affixed to said platform.

6. A mechanic's recliner chair as recited in claim 1 and further comprising an adjustable light affixed to said back support.

7. A mechanic's chair as recited in claim 1 wherein said one-piece seating unit is a molded body in the form generally referred to as a bucket seat configured to conform to the body of a user.

8. A mechanic's recliner chair as recited in claim 1 and further comprising braking means affixed to said platform and adapted to selectively engage said floor surface and resist movement of said platform.

9. A mechanic's recliner chair as recited in claim 1 and further comprising braking means for selectively preventing movement of said platform relative to said floor surface.

* * * * *

UNITED STATES PATENT AND TRADEMARK OFFICE

CERTIFICATE OF CORRECTION

PATENT NO. : 5,897,122

DATED : April 27, 1999

INVENTOR(S) : Willy Borner

It is certified that error appears in the above-indentified patent and that said Letters Patent is hereby corrected as shown below:

Column 4, line 10, after "seating" insert --unit--.

Signed and Sealed this

Twenty-eighth Day of March, 2000

*Attest:*

Q. TODD DICKINSON

*Attesting Officer*

*Commissioner of Patents and Trademarks*